US009120647B2

(12) United States Patent
Liang et al.

(10) Patent No.: US 9,120,647 B2
(45) Date of Patent: Sep. 1, 2015

(54) INVERTER AND AN ESCALATOR CONTROL DEVICE WITH THE INVERTER

(71) Applicant: KONE CORPORATION, Helsinki (FI)

(72) Inventors: Cai Xiao Liang, Suzhou (CN); Xu Bo Xia, Kunshan (CN); Zhou Tai Lai, Suzhou (CN)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/107,849

(22) Filed: Dec. 16, 2013

(65) Prior Publication Data

US 2014/0166434 A1 Jun. 19, 2014

(30) Foreign Application Priority Data

Dec. 17, 2012 (CN) ..... 2012 1 0548107

(51) Int. Cl.
*B66B 25/00* (2006.01)
*B66B 21/00* (2006.01)
*B66B 27/00* (2006.01)

(52) U.S. Cl.
CPC ..... *B66B 25/003* (2013.01); *B66B 25/00* (2013.01)

(58) Field of Classification Search
None
See application file for complete search history.

(56) References Cited

U.S. PATENT DOCUMENTS 4,499,986 A * 2/1985 Tsuboi et al. ..... 198/322
6,049,189 A 4/2000 Markus et al.
2010/0327795 A1* 12/2010 Jahkonen ..... 318/504

FOREIGN PATENT DOCUMENTS

DE 43 13 424 A1 10/1994
EP 1394097 A1 * 3/2004
WO WO 94/25386 A1 11/1994

* cited by examiner

*Primary Examiner* — Kavel Singh
(74) *Attorney, Agent, or Firm* — Birch, Stewart, Kolasch & Birch, LLP

(57) ABSTRACT

An inverter for an escalator control device and an escalator control device are provided. The inverter includes: a control unit for receiving a detection signal from the passenger detector; a frequency inverting unit for inverting current frequency, input terminals of which are connected to the public electrical net, and which is connected with the output terminal of the control unit; a frequency inverting unit contactor, input terminals of which are connected to the frequency inverting unit, and output terminals of which are connected to a motor of the escalator; and a public electrical net contactor, input terminals of which are connected to a public electrical net, and output terminals of which are connected to the motor of the escalator.

13 Claims, 1 Drawing Sheet

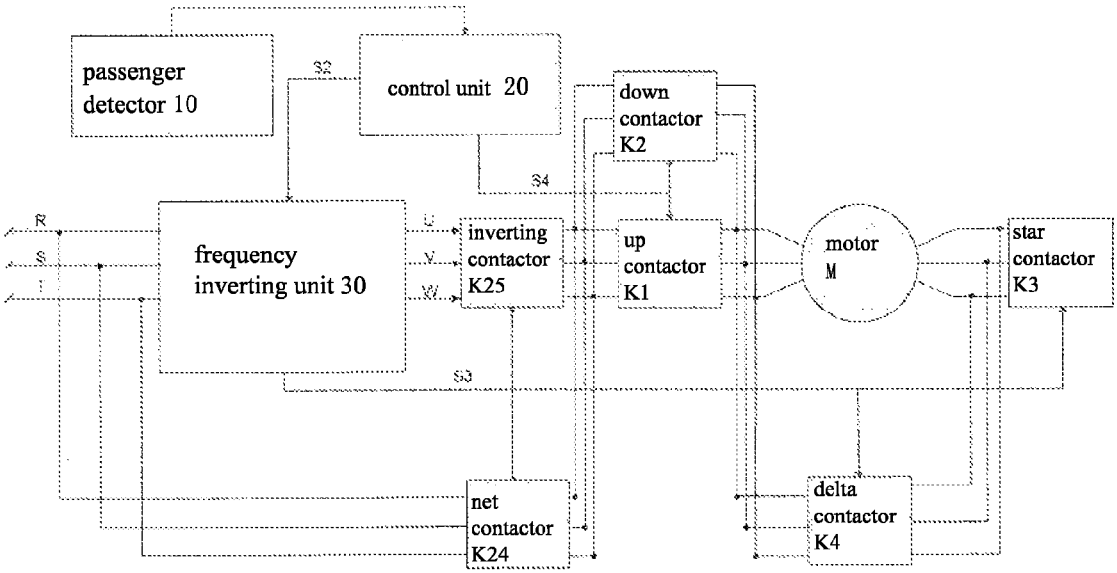
passenger detector 10
control unit 20
S2
down contactor K2
S4
R
S
T
frequency inverting unit 30
U
V
W
inverting contactor K25
up contactor K1
motor M
star contactor K3
S3
net contactor K24
delta contactor K4

INVERTER AND AN ESCALATOR CONTROL DEVICE WITH THE INVERTER

TECHNICAL FIELD

The present invention relates to an inverter and an escalator control device having an inverter.

BACKGROUND

An inverter is a device for inverting the current of the public electric net into a current with different frequency through the connection and disconnection of its semi-conductors. With the help of the inverter inverting the current frequency, for example, the running speed of a motor connected with the inverter may be changed.

The inverter is widely used in the movement control of the escalator. The movement control of the escalator at lest relates to the switch between/among a variety of movement modes like mode of low speed running, mode of waiting with zero speed, mode of high speed running etc. In the prior arts, the aforesaid switch is achieved by additionally providing a separate control device, some contactors and so on. Particularly, the control device is connected with the inverter and the contactors, and the control device may control the open and close of the contactors and the output of the inverter.

The way of achieving the control of the movement of the escalator by separately providing a control device and contactors as mentioned above at least have below disadvantages:

First, since a separate control device is needed, the cost of the whole control system of the escalator increases.

Second, since there is a separate control device, the user has to do some operations like line connections between the control device and the inverter. However, the operations are time-consuming, and sometimes there is a risk of wrong connection. What's more, the user is even required to do some programming work and some other works to initialize the system, which results in the increase of the human cost and obstructs the fast installation of the control system of escalator on the spot.

Third, since the control of the inverter and the contactors is via some related programs done by the user, the response of the control may be not so fast.

Thus, there is a need for providing an escalator control device with its inverter which at least may solve some or all of the problems as mentioned above.

SUMMARY OF INVENTION

First of all, what shall be noted is that, in the present application, the term "escalator" comprises, but is not limited to, an escalator, moving walk, moving stairs, etc. used in a store, supermarket, airport lobby etc., which may be horizontally arranged to horizontally convey passengers, or be inclined to convey passengers from a certain height to another height.

In one of a preferred embodiment of the present invention, it is provided an inverter for an escalator control device, comprising: a control unit, input terminals of which are connected to a passenger detector for detecting a riding of a passenger, and which may receive a detection signal from the passenger detector; a frequency inverting unit for inverting current frequency, input terminals of which are connected to the public electrical net, and which is connected with the output terminal of the control unit; a frequency inverting unit contactor, input terminals of which are connected to the frequency inverting unit, and output terminals of which are connected to a motor of the escalator; and a public electrical net contactor, input terminals of which are connected to a public electrical net, and output terminals of which are connected to the motor of the escalator; wherein the inverter is configured as that: when the escalator is running with low speed or is waiting with zero speed, the frequency inverting unit contactor is closed and the public electrical net contactor is open; and in this case, if the passenger detector has detected there is a passenger who is going to ride the escalator, the passenger detector sends a signal to the control unit, and the control unit then sends a signal of commanding high speed running to the frequency inverting unit, and the frequency inverting unit then increases the output current frequency to increase the running speed of the escalator; and when the running speed of the escalator reaches a predetermined nominal speed, the frequency inverting unit commands the frequency inverting unit contactor to be open and the public electrical net contactor to be closed, thus the motor of the escalator is switched from being driven via the frequency inverting unit to being driven directly by the public electrical net, and the escalator runs with the normal speed. It can be seen that in the present invention, the inverter itself has included components like the inverter and contactors, and the control of the movement of the escalator is achieved by the inverter and the contactors of the inverter itself, which is completely different with the prior art wherein the control of the escalator is through additionally providing separate control devices and contactors. With this preferred embodiment, at least some or all of the below advantageous technical effects may be achieved:

First, a separate control device is not needed, which results in the decrease of the cost of the whole control system of the escalator.

Second, the connection and communication protocol between/among the inverter unit, the control unit and the contactors of the inverter may be preset by the manufacturer, and thus the user is just needed to connect the inverter and the motor, which results in the simplification of the user's operation and the speed up of the installation on the spot.

Third, since the communications between the components are inside of the inverter and the programs and communication protocols are preset and optimized by the manufacturer, the inverter of the present invention will have faster response, compared with the prior art wherein the programs are made by the users and the communications are between the inverter and the control device outside of the inverter.

In the preceding preferred embodiment of the present invention, more preferably, the inverter is further configured as that: when the escalator runs with the nominal speed, if the passenger detector detects that there has been no passenger riding the escalator for a predetermined duration, the passenger detector sends a signal to the control unit, then the control unit sends a signal of commanding low speed running to the frequency inverting unit, and the frequency inverting unit then commands the public electrical net contactor to be open and the frequency inverting unit contactor to be closed, thus the motor of the escalator is switched from being driven directly by the public electrical net to being driven via the frequency inverting unit, then through the frequency inverting unit inverting the current frequency, the escalator is slow down and kept to the predetermined low speed, or enters waiting status with zero speed after a predetermined duration. With this embodiment, the inverter of the present invention achieves the switch between/among the modes of low speed running, high speed running and waiting with zero speed through a simple structure.

In any one of the preceding preferred embodiments of the present invention, more preferably, the inverter further comprises: an up contactor and a down contactor connected in parallel between the frequency inverting unit contactor and the motor, for controlling the up and down movement of the escalator respectively; wherein the up contactor and the down contactor are also connected in parallel between the public electrical net contactor and the motor, whereby, any one of the frequency inverting unit contactor and the public electrical net contactor is connected to the motor via any one of the up contactor and the down contactor, wherein, the control unit is configured to command one of the up contactor and the down contactor to be closed and the other to be open, thus achieving the control of the up and down movement of the escalator. With the inverter of this embodiment, the up movement and down movement of the escalator may be achieved, which avoids the excess abrasion of the components of the escalator otherwise with a single movement direction, and makes the escalator be able to be flexibly applied in the situations comprising a situation of the escalator only used for up movement, a situation of the escalator only used for down movement and a situation of the escalator used for both up movement and down movement.

In any one of the preceding preferred embodiments of the present invention, more preferably, the inverter further comprises: a delta connection contactor connected to the motor of the escalator to achieve a delta connection of the motor; and a star connection contactor connected to the motor of the escalator to achieve a star connection of the motor; wherein when a load of the escalator is smaller than a predetermined load threshold, the frequency inverting unit commands the delta connection contactor to be open and the star connection contactor to be closed; and when the load of the escalator is greater or equal to the predetermined load threshold, the frequency inverting unit commands the delta connection contactor to be closed and the star connection contactor to be open. Thus, the inverter according to this embodiment of the preset invention may realize the switch of the connection of the motor between the star connection and the delta connection. Further, since when the load of the escalator is smaller than a predetermined load threshold, the load of the motor is relatively low and thus the motor does not need relatively high driving current. In this situation, the frequency inverting unit switches the motor to be in star connection with relatively low current, then the heat generated by the windings of the motor is relatively low, which may reduce the energy consumption, and thus reduce the operation cost of the escalator. More particularly, for example, for a 380V input voltage, if the motor is in a star connection, the phase voltage is 220V, the total heat generated by the three windings of the motor will be $3*(U2/R)*t=3*(220*220/R)*t$, wherein t represents the running time of the motor and R represents the resistance of one winding of the motor; if the motor is in delta connection, the phase voltage will be 380V, the total heat generated by the three windings of the motor will be $3*(U2/R)*t=3*(380*3800/R)*t$. It can be seen that for the given resistance R of the windings of the motor and for the given time t, the total heat generated by the motor in star connection will be lower than that generated by the motor in delta connection, therefore the motor in star connection will have lower energy loss and will be more energy saving. In addition, the motor in star connection will not generate eddy-current. In contrast, for a motor in delta connection, since the three windings can not be absolutely identical, the phase voltages of the three windings will be different in some degree, which may generate eddy current which may result in heat loss or energy waste or even decrease the efficiency of the motor. Therefore, in the situation that the motor is capable of smoothly driving the load, i.e. the escalator load is lower than a predetermined load threshold as mentioned above, a motor in star connection is preferred. It can be seen that compared with the motor of a conventional escalator which is always fixed in for example delta connection, the inverter, escalator control device and escalator system of the present invention will be more energy saving.

In any one of the preceding preferred embodiments of the present invention, more preferably, the inverter further comprises aforesaid passenger detector. For this embodiment, the passenger detector like a sensor becomes a component of the inverter itself too, and the passenger detector may be provided by the manufacturer same with the manufacturer of the inverter, therefore, the user is not needed to seek for an additional passenger detector suitable for the inverter or escalator, thus, the fast installation of the escalator control system is achieved.

In another embodiment of the present invention, it is provided an escalator control device comprising an inverter according to any one of the preceding preferred embodiments of the present invention.

It should be understood that the description above are intended for purposes of illustration only and are not intended to limit the scope of the present disclosure.

DESCRIPTION OF DRAWINGS

The drawings described herein are for illustration purposes only and are not intended to limit the scope of the present disclosure in any way.

FIG. 1 is a circuit bock diagram of the inverter according to a particularly preferred embodiment of the present invention.

EMBODIMENTS

The preferred embodiments of the present invention will be described with referring to the FIGURE.

The preceding and other technical features and technical effects related with the present invention will become apparent from the description provided hereafter in connection with the FIGURE.

Referring to FIG. 1, a circuit bock diagram of the inverter according to a particularly preferred embodiment of the present invention is described. It shall be noted that the embodiment illustrated in FIG. 1 is just a very particular and preferable embodiment of the present invention, and the skilled people may understand that this embodiment is just a preferred one, and the present invention is not limited to this. For example, some technical features, like certain components, as shown in FIG. 1, are not essential and necessary for solving a given technical problem. Thus, the formation of a technical solution or the solving of a technical problem will not be impacted even without these features.

The inverter according to a preferred embodiment of the present invention as shown in FIG. 1 comprises: a passenger detector 10 for detecting the riding of the passenger; a control unit 20, input terminals of which are connected the passenger detector 10 and which may receive the detection signal from the passenger detector 10; a frequency inverting unit 30 for inverting current frequency, input terminals of which are connected to the public electrical net R, S, T, and one of the output terminals of which is connected (S2) to the inverter unit 30; a frequency inverting unit contactor K25, the input terminals of which are connected (U, V, W) to the frequency inverting unit 30; a public electrical net contactor K24, input terminals of which are connected to a public electrical net; an up contactor K1 and a down contactor K2 connected in parallel between the frequency inverting unit contactor K25 and the motor M, and also connected in parallel between the a public electrical net contactor K24 and the motor M, whereby, any one of the frequency inverting unit contactor K25 and the public electrical net contactor K24 is connected to the motor M via any one of the up contactor K1 and the down contactor K2; a delta connection contactor K4 connected to the motor M of the escalator to achieve the delta connection of the motor M; and a star connection contactor K3 connected to the motor M of the escalator to achieve the star connection of the motor M, wherein the delta connection contactor K4 and the star connection contactor K3 are connected (S3) to the frequency inverting unit 30 to be controlled by the frequency inverting unit 30.

In operation, the inverter is configured as that: when the escalator is running with low speed or is waiting with zero speed, the frequency inverting unit contactor K25 is closed and the public electrical net contactor K24 is open; and in this case, if the passenger detector 10 has detected there is a passenger who is going to ride the escalator, the passenger detector 10 sends a signal to the control unit 20, and the control unit 20 then sends a signal of commanding high speed running to the frequency inverting unit 30, and the frequency inverting unit 30 then increases the output current frequency to increase the running speed of the escalator; and when the running speed of the escalator reaches a predetermined nominal speed, the frequency inverting unit 30 commands the frequency inverting unit contactor K25 to be open and the public electrical net contactor K24 to be closed, thus the motor M of the escalator is switched from being driven via the frequency inverting unit 30 to being driven directly by the public electrical net, and the escalator runs with the nominal speed. In the preceding operation, when a load of the escalator is smaller than a predetermined load threshold, the frequency inverting unit 30 commands the delta connection contactor K4 to be open and the star connection contactor K3 to be closed; and when the load of the escalator is greater or equal to the predetermined load threshold, the frequency inverting unit 30 commands the delta connection contactor K4 to be closed and the star connection contactor K3 to be open. Thus, as mentioned above, the inverter, the escalator control device and the escalator of the present invention may achieve energy saving. The aforesaid load threshold may be flexibly set, for example, may be set as 80% of the maximum load or 80% of the nominal load.

Further, when the escalator runs with the nominal speed, if the passenger detector 10 detects that there has been no passenger riding the escalator for a predetermined duration, the passenger detector 10 sends a signal to the control unit 20, then the control unit 20 sends a signal of commanding low speed running to the inverting unit 30, and the frequency inverting unit 30 then commands the public electrical net contactor K24 to be open and the frequency inverting unit contactor K25 to be closed, thus the motor M of the escalator is switched from being driven directly by the public electrical net to being driven via the frequency inverting unit 30, then through the frequency inverting unit inverting the current frequency, the escalator is slow down and kept to the predetermined low speed, or enters waiting status with zero speed after a predetermined duration. Thus, the escalator is prevented to run in a high speed if there is no passenger riding the escalator. Accordingly, energy waste and unnecessary abrasion are avoided.

As shown in FIG. 1 and as also mentioned above, in a particularly preferred embodiment of the present invention, the inverter further comprises a up contactor K1 and a down contactor K2, wherein, the control unit 20 is connected (S4) with them, and controls one of them to be closed and the other to be open, therefore the control of the up and down movement of the escalator is achieved.

Further, as shown in FIG. 1 and as also mentioned above, in a particularly preferred embodiment of the present invention, the inverter further comprises a delta connection contactor K4 for achieving the delta connection of the motor and a star connection contactor K3 for achieving the star connection of the motor. In operation, when the load of the escalator is smaller than a predetermined load threshold, the frequency inverting unit 30 commands the delta connection contactor K4 to be open and the star connection contactor K3 to be closed, thus the motor M is in star connection, the energy consumption will be decreased; and when the load of the escalator is greater or equal to the predetermined load threshold, the frequency inverting unit 30 commands the delta connection contactor K4 to be closed and the star connection contactor K3 to be open, thus the motor M is in delta connection, and thus may have greater output torque.

It shall be noted that in the preferred embodiment of adopting contactors K24, K25, K3, K4, since the control of the open and close of the contactors K24 and K25 is depend on the speed of the escalator, and the control of the open and close of the contactors K3 and K4 is depend on the load of the escalator, these two controls are separate, therefore, when the motor M of the escalator is switched to being driven directly by the public electric net rather than being driven via the frequency inverting unit, the connection of the motor M of the present invention may still be switched between star connection and delta connection depending on the escalator load to change the current flowing through the windings of the motor and thus to realize the reduce of the heat generated by the motor windings and thus the energy saving. In contrast, for a inverter having contactors K24 and K25 but without contactors K3 and K4, although the input current of the motor may be changed by the frequency inverting unit, when the motor is switched to being driven directly by the public electric net, the current change of the motor can not be realized. Therefore, the embodiment having contactors K24, K25, K3 and K4 has great advantageousness compared with the solution having only contactors K24, K25 without the contactors K3, K4.

As emphasized before, the embodiment shown in FIG. 1 of the present invention is just a particularly preferred embodiment, and some components shown are not necessary to solve a certain technical problem. Below some description are made on this.

First, for example, the passenger detector may be set as one not belonging to the inverter. In this situation, the user may seek for a suitable passenger detector for the escalator, or may require the manufacturer providing an inverter having or not having the passenger detector and thus have great choosing freedom.

Further, in the present invention, the inverter may not have the up contactor and the down contactor. In this situation, the output terminals of the frequency inverting unit contactor K25 may be directly connected to the motor M and the output terminals of the public electric net contactor K24 may be directly connected to the motor too. In this situation, the escalator can only run in a single direction. However, it does not impact the realization of the advantageous technical effect brought by the inverter of the present invention which is integrated with a control unit to control the close and open of each contactor.

Further, in the present invention, the inverter may have no star connection contactor K3 and delta connection contactor K4. In this situation, the motor just has a single mode of connection, i.e. star connection or delta connection. However, this does not impact the realization of the advantageous technical effect brought by the inverter of the present invention which is integrated with a control unit to control the close and open of each contactor.

Still further, in the present invention, the inverter may have or have no any one of or all of the up contactor, down contactor, star connection contactor and delta connection contactor.

While the disclosure has been described in the specification and illustrated in the drawings with reference to various embodiments, it will be understood by those skilled in the art that various changes may be made and equivalents may be substituted for elements thereof without departing from the scope of the disclosure as defined in the claims. Furthermore, the mixing and matching of features, elements and/or functions between various embodiments is expressly contemplated herein so that one of ordinary skill in the art would appreciate from this disclosure that features, elements and/or functions of one embodiment may be incorporated into another embodiment as appropriate, unless described otherwise above. Moreover, many modifications may be made to adapt a particular situation or material to the teachings of the disclosure without departing from the essential scope thereof. Therefore, it is intended that the disclosure not be limited to the particular embodiment illustrated by the drawings and described in the specification as the best mode presently contemplated for carrying out this disclosure, but that the disclosure will include any embodiments falling within the foregoing description and the appended claims.

The invention claimed is:

1. An inverter for an escalator control device, comprising:

a control unit, input terminals of which are connected to a passenger detector for detecting a riding of a passenger, and which may receive a detection signal from the passenger detector;

a frequency inverting unit for inverting current frequency, input terminals of which are connected to the public electrical net, and which is connected with the output terminal of the control unit;

a frequency inverting unit contactor, input terminals of which are connected to the frequency inverting unit, and output terminals of which are connected to a motor of the escalator; and a public electrical net contactor, input terminals of which are connected to a public electrical net, and output terminals of which are connected to the motor of the escalator;

wherein the inverter is configured as that:

when the escalator is running with low speed or is waiting with zero speed, the frequency inverting unit contactor is closed and the public electrical net contactor is open;

and in this case, if the passenger detector has detected there is a passenger who is going to ride the escalator, the passenger detector sends a signal to the control unit, and the control unit then sends a signal of commanding high speed running to the frequency inverting unit, and the frequency inverting unit then increases the output current frequency to increase the running speed of the escalator;

and when the running speed of the escalator reaches a predetermined nominal speed, the frequency inverting unit commands the frequency inverting unit contactor to be open and the public electrical net contactor to be closed, thus the motor of the escalator is switched from being driven via the frequency inverting unit to being driven directly by the public electrical net, and the escalator runs with the normal speed, and wherein the inverter further comprises:

a delta connection contactor connected to the motor of the escalator to achieve a delta connection of the motor; and a star connection contactor connected to the motor of the escalator to achieve a star connection of the motor;

wherein when a load of the escalator is smaller than a predetermined load threshold, the frequency inverting unit commands the delta connection contactor to be open and the star connection contactor to be closed; and when the load of the escalator is greater or equal to the predetermined load threshold, the frequency inverting unit commands the delta connection contactor to be closed and the star connection contactor to be open.

2. An inverter according to claim 1, wherein the inverter is further configured as that:

when the escalator runs with the nominal speed, if the passenger detector detects that there has been no passenger riding the escalator for a predetermined duration, the passenger detector sends a signal to the control unit, then the control unit sends a signal of commanding low speed running to the frequency inverting unit, and the frequency inverting unit then commands the public electrical net contactor to be open and the frequency inverting unit contactor to be closed, thus the motor of the escalator is switched from being driven directly by the public electrical net to being driven via the frequency inverting unit, then through the frequency inverting unit inverting the current frequency, the escalator is slow down and kept to the predetermined low speed, or enters waiting status with zero speed after a predetermined duration.

3. An inverter according to claim 1, wherein the inverter further comprises:

an up contactor and a down contactor connected in parallel between the frequency inverting unit contactor and the motor, for controlling the up and down movement of the escalator respectively;

wherein the up contactor and the down contactor are also connected in parallel between the public electrical net contactor and the motor, whereby, any one of the frequency inverting unit contactor and the public electrical net contactor is connected to the motor via any one of the up contactor and the down contactor, wherein, the control unit is configured to command one of the up contactor and the down contactor to be closed and the other to be open, thus achieving the control of the up and down movement of the escalator.

4. An inverter according to claim 3, wherein the inverter further comprises:

a delta connection contactor connected to the motor of the escalator to achieve a delta connection of the motor; and a star connection contactor connected to the motor of the escalator to achieve a star connection of the motor;

wherein when a load of the escalator is smaller than a predetermined load threshold, the frequency inverting unit commands the delta connection contactor to be open and the star connection contactor to be closed; and when the load of the escalator is greater or equal to the predetermined load threshold, the frequency inverting unit commands the delta connection contactor to be closed and the star connection contactor to be open.

5. An inverter according to claim 1, wherein the inverter further comprises said passenger detector.

6. An escalator control device comprising an inverter according to claim 1.

7. An inverter according to claim 2, wherein the inverter further comprises:

an up contactor and a down contactor connected in parallel between the frequency inverting unit contactor and the motor, for controlling the up and down movement of the escalator respectively;

wherein the up contactor and the down contactor are also connected in parallel between the public electrical net contactor and the motor, whereby, any one of the frequency inverting unit contactor and the public electrical net contactor is connected to the motor via any one of the up contactor and the down contactor, wherein, the control unit is configured to command one of the up contactor and the down contactor to be closed and the other to be open, thus achieving the control of the up and down movement of the escalator.

8. An inverter according to claim 2, wherein the inverter further comprises:

a delta connection contactor connected to the motor of the escalator to achieve a delta connection of the motor; and a star connection contactor connected to the motor of the escalator to achieve a star connection of the motor;

wherein when a load of the escalator is smaller than a predetermined load threshold, the frequency inverting unit commands the delta connection contactor to be open and the star connection contactor to be closed; and when the load of the escalator is greater or equal to the predetermined load threshold, the frequency inverting unit commands the delta connection contactor to be closed and the star connection contactor to be open.

9. An inverter according to claim 2, wherein the inverter further comprises said passenger detector.

10. An escalator control device comprising an inverter according to claim 2.

11. An escalator control device comprising an inverter according to claim 3.

12. An escalator control device comprising an inverter according to claim 4.

13. An escalator control device comprising an inverter according to claim 5.

* * * * *